US006292087B1

(12) United States Patent
Castonguay, Jr. et al.

(10) Patent No.: US 6,292,087 B1
(45) Date of Patent: Sep. 18, 2001

(54) FUSE INDICATOR LABEL

(75) Inventors: Roland J. Castonguay, Jr., Leicester; Michael F. Paul, Brookfield; James L. Potter, Warren; Daniel P. Segall, Longmeadow; John R. Pennace, Paxton, all of MA (US)

(73) Assignee: FLEXcon Company, Inc., Spencer, MA (US)

( * ) Notice: Subject to any disclaimer, the term of this patent is extended or adjusted under 35 U.S.C. 154(b) by 0 days.

(21) Appl. No.: 09/668,512

(22) Filed: Sep. 22, 2000

Related U.S. Application Data

(63) Continuation of application No. 09/361,441, filed on Jul. 26, 1999, which is a continuation of application No. 09/126,911, filed on Jul. 31, 1998, now Pat. No. 5,994,993.

(51) Int. Cl.[7] ..... H01H 85/30

(52) U.S. Cl. ..... 337/206; 337/241; 337/243; 337/265

(58) Field of Search ..... 337/206, 241, 337/265, 266, 267, 332, 376, 79, 243, 244

(56) References Cited

U.S. PATENT DOCUMENTS

| | | | | |
|---|---|---|---|---|
| 821,873 | * | 5/1906 | Hoffmann | 337/241 |
| 1,246,417 | * | 11/1917 | Gilbert | 337/241 |
| 1,591,029 | | 7/1926 | Feldkamp . | |
| 1,793,103 | | 2/1931 | LaMar . | |
| 2,115,469 | | 4/1938 | Quisling . | |
| 2,164,658 | | 7/1939 | Lyon . | |
| 2,702,329 | | 2/1955 | Dietz, Jr. et al. . | |
| 2,734,967 | | 2/1956 | Benedict . | |
| 2,788,423 | | 4/1957 | Lang . | |
| 3,396,335 | | 8/1968 | Burr et al. . | |
| 3,794,953 | | 2/1974 | Malin . | |
| 3,814,139 | * | 6/1974 | Loyd et al. | 138/141 |
| 3,826,141 | | 7/1974 | Pickett et al. . | |
| 3,997,862 | | 12/1976 | Kozacka et al. . | |
| 4,127,837 | | 11/1978 | Borchart . | |
| 4,142,151 | | 2/1979 | Hansen . | |
| 4,308,516 | * | 12/1981 | Shimada et al. | 337/241 |
| 4,401,356 | * | 8/1983 | Bare | 339/258 R |
| 4,641,120 | | 2/1987 | Bonfig et al. . | |
| 4,760,367 | * | 7/1988 | Williams | 337/241 |
| 4,835,476 | | 5/1989 | Kurosawa . | |
| 5,111,177 | | 5/1992 | Krueger et al. . | |
| 5,196,819 | | 3/1993 | Roberts . | |
| 5,225,473 | * | 7/1993 | Duan | 524/388 |
| 5,604,049 | | 2/1997 | Weiss et al. . | |
| 5,612,151 | | 3/1997 | Hughen . | |
| 5,673,028 | | 9/1997 | Levy . | |
| 5,776,371 | | 7/1998 | Parker . | |
| 5,936,508 | | 8/1999 | Parker . | |

FOREIGN PATENT DOCUMENTS

| | | |
|---|---|---|
| 1093482 | 12/1967 | (GB) . |
| WO 86/06873 | 11/1986 | (WO) . |
| WO 97/39458 | 10/1997 | (WO) . |

* cited by examiner

*Primary Examiner*—Leo P. Picard
*Assistant Examiner*—Anatoly Vortman
(74) *Attorney, Agent, or Firm*—Samuels, Gauthier & Stevens

(57) ABSTRACT

A fuse indicator is disclosed for indicating the status of a fuse. The fuse indicator includes a conductive material adapted to extend between conductive ends of a fuse, and adapted to undergo a visible change in appearance upon being subjected to electrical current above a threshold. The fuse indicator further includes an adhesive for maintaining contact between the conductive material and the conductive ends of the fuse.

8 Claims, 3 Drawing Sheets

FUSE INDICATOR LABEL

This application is a continuation application of Ser. No. 09/361,441 filed Jul. 26, 1999, which is a continuation application of Ser. No. 09/126,911 filed Jul. 31, 1998 now U.S. Pat. No. 5,994,993.

BACKGROUND OF THE INVENTION

The invention relates to fuse, and particularly relates to fuse indicators for indicating the status of a fuse.

Although fuses are ubiquitous in electrical system, serving to protect the electrical systems themselves as well as the safety of persons using the systems, the detection of whether a fuse has been overcharged, (or blown), is often expensive and time consuming, particularly if an electrical system includes numerous fuses. Many fuses undergo no physical change in appearance upon being overcharged. Moreover, sometimes the contacts within a fuse may separate due to the fuse having undergone too many cycles of on-off use or too many cycles between widely varying temperatures, leaving no visible indication of having developed an open circuit. Fuse indicators have been developed to permit more rapid identification of the status of a fuse, typically by visual inspection of an indicator portion of a fuse.

Conventional fuse indicators generally include either a current sensor circuit that provides a visible indication of whether current is flowing through the fuse, or include a second fusable conductor path in parallel with the fuse filament. Fuse indicators with current sensor circuits include those disclosed in U.S. Pat. No. 4,641,120 which discloses a current sensor circuit that uses the current flowing through the fuse to light a light emitting diode (LED), and U.S. Pat. No. 2,164,658 which discloses a current sensor circuit including a lamp and resistor in parallel with the fuse. Such fuse indicators, however, are typically expensive to manufacture and must be carefully handled so as to not disturb the current sensor circuit. Further, such fuse indicators require that the power to circuit be on in order to identify whether the LED or lamp should be activated. This may be not only inconvenient, but dangerous as well.

Fuse indicators that include a second conductor path are typically designed such that the second conductor path has a higher resistance than the fusable filament, and the second conductor path undergoes a visible change when subjected to excess current. During use, when excess current flows through the fuse filament (i.e., when the fuse is activated by overheating, or blows), then the current will travel the second conductor path and immediately cause it to undergo the desired visible change as the second conductor path is overheated, leaving an open circuit. For example, U.S. Pat. No. 1,793,103 discloses a fuse indicator, including a fusible wire within a transparent glass tube. Such fuse indicators, however, are also generally expensive and require delicate handling to ensure that the second conductor path is not disturbed.

Although the above types of fuse indicators have been known for quite some time, the need remains for a fuse indicator that reliably indicates the status of a fuse, yet is inexpensive to manufacture, is easily handled, and is convenient to use.

SUMMARY OF THE INVENTION

The invention provides a fuse indicator for indicating the status of a fuse. The fuse indicator includes a conductive material adapted to extend between conductive ends of a fuse, and adapted to undergo a visible change in appearance upon being subjected to electrical current above a threshold. The fuse indicator of the invention further includes an adhesive for maintaining contact between the conductive material and the conductive ends of the fuse.

BRIEF DESCRIPTION OF THE DRAWINGS

The following detailed description of the illustrated embodiment may be further understood with reference to the accompanying drawings in which.

The drawings are for illustrative purposes only and are not to scale.

DETAILED DESCRIPTION OF THE ILLUSTRATED EMBODIMENTS

The invention provides a fuse indicator that may be applied to a fuse as a label. A fuse indicator of the invention includes a clear thin film and a thin conductive film adhered to one side of the clear film. The opposite side of the clear film may be print receptive, and information such as fuse data may be printed on the film as a label. Either end of the conductive film may be positioned to contact the two conductive ends of a fuse to form an electrical connection with the fuse in parallel with the fuse filament.

The conductive path provided by the conductive film is of a resistance that is higher than the resistance of the fuse filament. In normal use, therefore, the current will prefer to travel the conductive path of the fuse filament. If the fuse filament is overcharged and blows, then the current will travel the conductive path provided by the conductive film. The conductive film will then be overcharged and will undergo a deformation or discoloration. This change will be visible through the clear film, and will serve as an indication of the status of the fuse.

EXAMPLE 1

Figure 1:
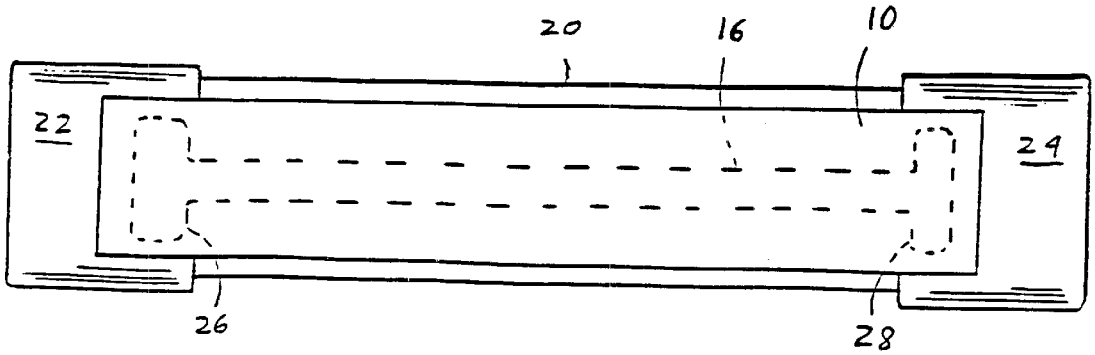
FIG. 1 shows a top view of a fuse indicator label of the invention applied to a conventional cartridge type fuse.
Figure 2:
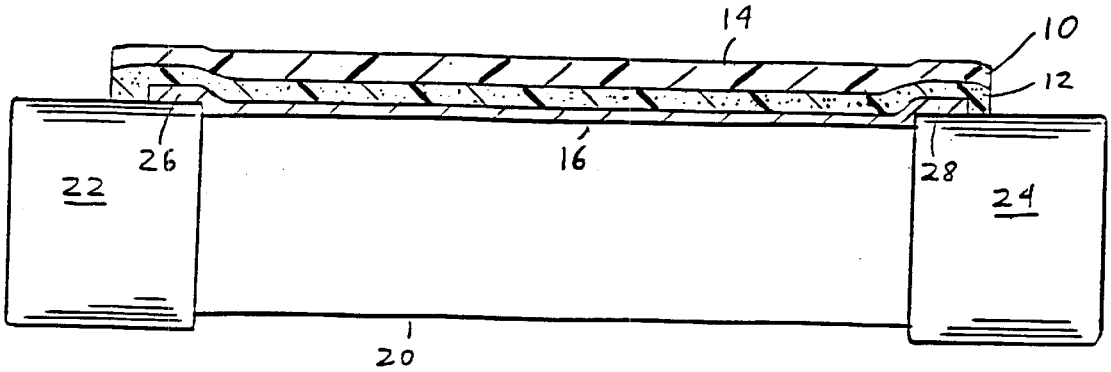
FIG. 2 shows a side view of the fuse indicator label and fuse of FIG. 1 with the fuse indicator label only shown in cross section taken lengthwise through the center of the fuse indicator label.

As shown in FIGS. 1 and 2, a fuse indicator of the invention includes a 2 mil clear polyesters film 10, on one side of which is applied a 1 mil clear pressure sensitive adhesive 12. The fuse indicator is shown in cross section and on an enlarged scale with respect to the fuse for illustrative purposes. The opposite side of the film is provided with a printable surface 14 on which information may be printed, e.g., fuse data and indicator information. The label is formed by vacuum depositing a layer of conductive material onto a carrier film such as polyester, which is then die cut into the desired shape as shown. An adhesive is then applied to the deposited conductive material. The conductive material does not extend beyond the clear polyester film or the adhesive 12.

Figure 3:
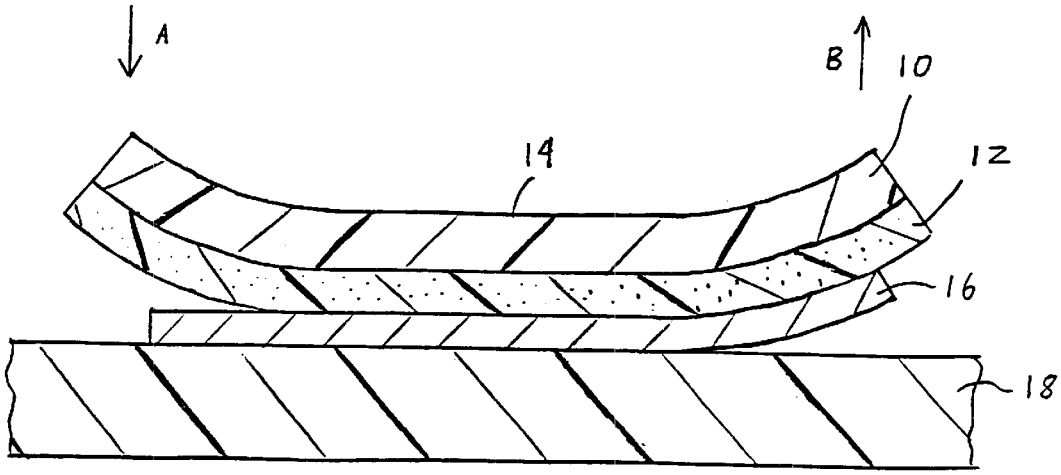
FIG. 3 shows a metallization transfer process for providing a metal layer on a fuse indicator label of the invention.

With reference to FIG. 3, in alternative embodiments, the metal conductor layer may be applied to the label by film transfer such as disclosed in U.S. patent application Ser. No. 09/020,150, the further disclosure of which is hereby incorporated by reference. Film transfer typically involves first vacuum depositing a metal such as aluminum 16 onto a carrier film 18 that includes a release coating, or is itself an inherently release substrate. The aluminum surface of the carrier film 18 may then be applied to the adhesive 12 as shown generally at A in FIG. 3. When the film 10 is removed from the carrier film 18, the aluminum deposit 16 is transferred to the adhesive 12 on the film 10 as shown generally at B in FIG. 3.

In further embodiments, other materials may be employed for use as the film, including polypropylene, polyethylene or polyamides, or polyethyl ether ketone etc, depending on the desired properties of the film taking into account the characteristics of the intended operating environment.

A fuse 20 typically includes conductor end portions 22 and 24, and the end portions 26 and 28 of the metallized component 16 are designed are designed to overlay one of end portions 22 and 24 respectively as shown in FIGS. 1 and 2. The fuse 20 may be, for example, a 15–30 Amp fuse and have a resistance on the order of 1 ohm. The resistance of the conductive portion 16 in this example, would be about 200–300 Ohms. During normal use, the current will preferentially flow through the path of least resistance, which is the fuse element itself. If the fuse 20 were to become overcharged and blow, then the current would immediately chose to flow through the conductive material, causing it too to blow. The conductive material 16 is designed to provide a distinctive indication of the conductive material 16 having become overcharged. For example, in one embodiment, the clear film 10 may become significantly discolored when the material 16 burns out. The label, therefore, provides an indication of the status of the fuse.

EXAMPLE 2

In this example, the conductive layer 36 is applied to the film 10 and adhesive 12, as a die-cut piece of metallized (vacuum deposition of aluminum onto a polyester film) with the conductive side facing away form the adhesive. By supporting the conductive layer in such a fashion prior to the application of the label, it is possible to increase the stiffness of the total composite, which may have advantages in certain applications, depending on the geometry of the fuse and the intended operating environment.

In further embodiments, an indicator label may be formed as in Example 2, using flame resistant films for the film 10. Such films may be, for example, rigid PVC, TEDLAR® brand poly vinyl fluoride, TEFLON® brand poly tetra fluoroethylene and its copolymer derivatives as sold by the E.I. duPont de Nemours & Co., Inc. of Wilmington, Del. Pressure sensitive adhesive containing flame suppressants such as antimony, boron, phosphates, etc. may also be used. The use of such materials may reduce the extend of damage to the fuse that may occur when the current that blows out the fuse is significantly higher than the fuse rating.

EXAMPLE 3

Figure 4:
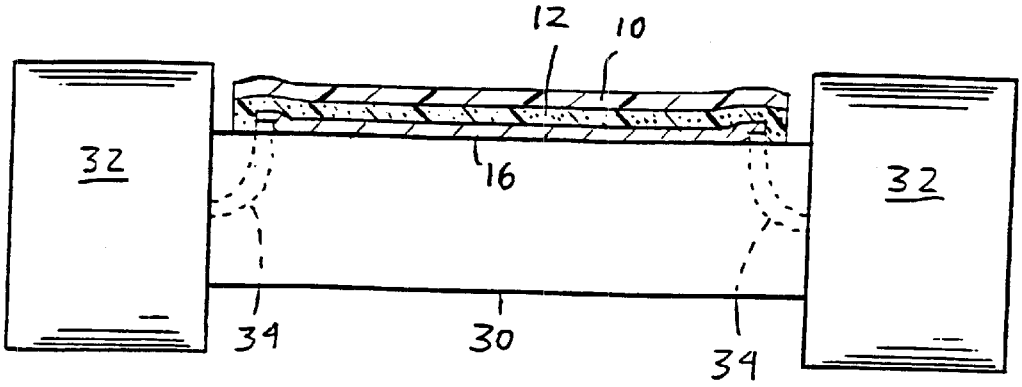
FIG. 4 shows a view similar to FIG. 2 of a fuse indicator label in accordance with another embodiment of the invention together with a fuse.

FIG. 4 shows another embodiment of the invention involving a fuse 30 having insulated end caps 32. As shown in FIG. 4, a fuse indicator label of the invention may be adhered to the fuse 30 such that the conductive material 36 of the fuse is in contact with conductor portions 34 of the fuse 30. The conductor portions 34 may extend from within the fuse 30, up to the surface of the fuse to provide electrical communication with either end of the fuse. Again, the resistance of the conductive material 36 should be such that the current will prefer to flow through the fuse element unless and until the fuse element is blown.

In this example, a conductive layer comprising a transferred metallized material is applied to an adhesive surface. The conductive layer 16 is formed of a vacuum deposition of aluminum to a thickness of between about 1,000 A and 50,000 A, and is preferably between about 10,000 A and 20,000 A. The conductive layer 16 is applied to the adhesive side 12 of a pressure sensitive adhesive coated label material. The placement of the conductive layer 16 is such that when the label is applied to a fuse cartridge, it must be done in registration with the conductive leads 34 on the surface of the fuse cylinder. The exposed conductive leads 34 are then completely covered by the label material.

In other embodiments, a fuse indicator label of the invention maybe employed with box type fuses wherein the leads of the fuse extend from one side of a cube toward a circuit to which the fuse is connected. Such fuse indicator labels may either contact conductor portions that extend to an exposed surface (e.g., the surface opposing the first surface from which the leads extend), or the fuse indicator label may wrap around the box type fuse to contact both leads on the first surface.

EXAMPLE 4

Figure 5:
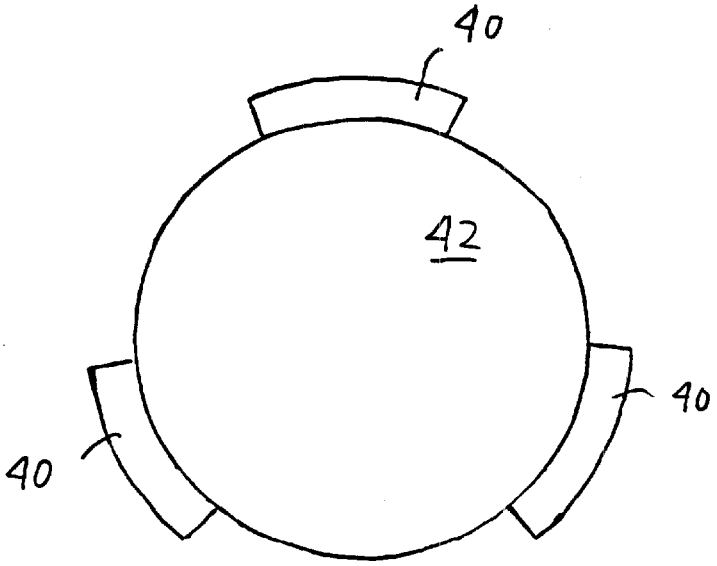
FIG. 5 shows an end view of a fuse including fuse indicator labels in accordance with another embodiment of the invention together.
Figure 6:
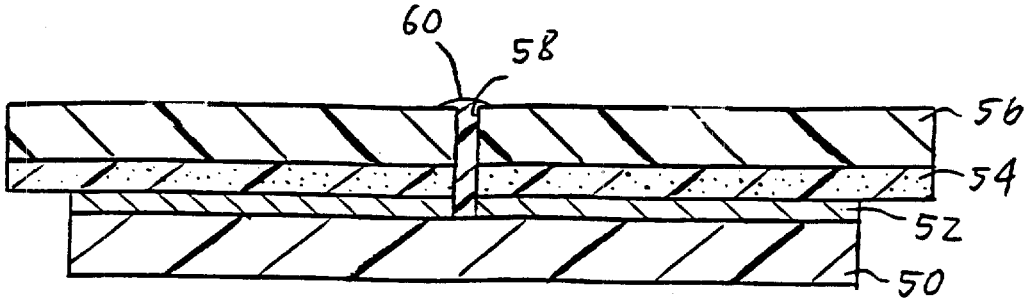
FIGS. 6 and 7 show side and top views respectively of a fuse indicator label in accordance with another embodiment of the invention prior to overcharging of the conductor portion of the fuse indicator label.
Figure 7:
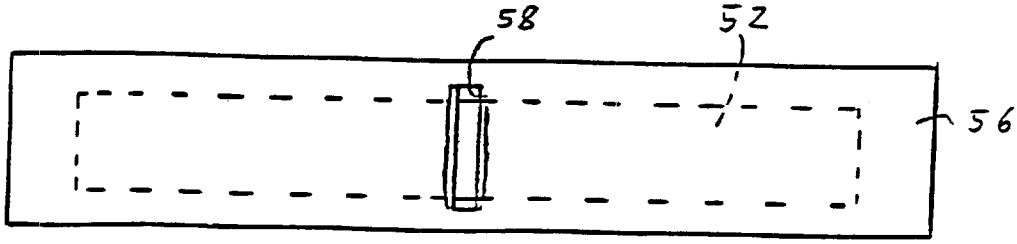
Figure 8:
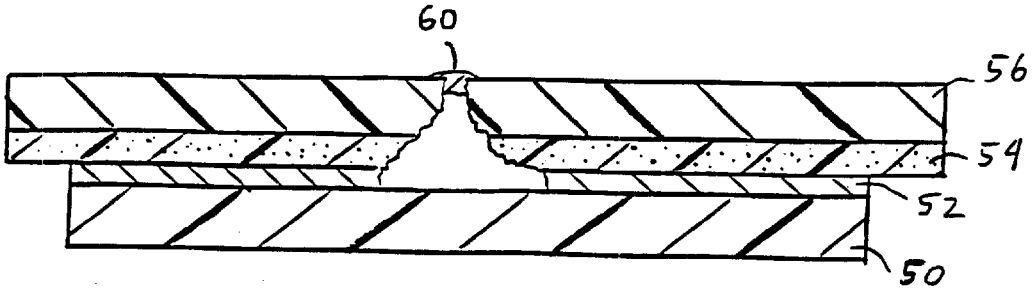
FIGS. 8 and 9 show side and top views respectively of the fuse indicator label of FIGS. 6 and 7 following overcharging of the conductor portion of the fuse indicator label.
Figure 9:
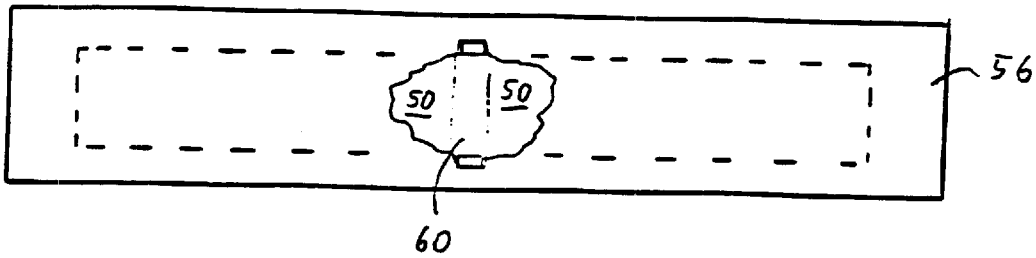

In still further embodiments of the invention, a plurality of indicator labels 40 may be positioned at various locations around a fuse 42 as shown in FIG. 5, which shows an end view of a fuse 42 including several indicator labels 40 thereon. During use, when one indicator label blows, the current being driven into the remaining indicator labels will increase, causing each of the other indicator labels to blow immediately thereafter. The result is that a fuse indicator label should be visible upon inspection irrespective of the positioning of the labels on the fuse. In other embodiments, one large label including several conductive paths may be wrapped around the fuse.

EXAMPLE 5

As shown in FIGS. 6–9, in another embodiment of the invention, an indicator fuse may include an indicator layer 50, a conductive material 52, an adhesive 54, and a clear protective layer 56. The conductive material 52 is not continuous and includes a small discontinuity or gap 58. The gap 58 may be filled with a clear dielectric material 60, such as polyethylene acrylic acid. In various embodiments, the dielectric material may cover a portion of the protective layer, or the gap may be left open and the dielectric material may comprise air from the atmosphere.

A fuse indicator label as shown in FIGS. 6–9 was prepared by vacuum depositing a ⅜ inch wide strip of aluminum to a thickness of about 16,000 A onto a transfer substrate. A 1.5 mil clear polyester label together with a 0.7 mil clear acrylic pressure-sensitive adhesive, was applied to the aluminum film and subsequently separated from the transfer substrate together with the aluminum film on the adhesive side. The label and adhesive extended beyond the edges of the aluminum layer. A 4.0 mil red PVC film was then applied to the aluminum such that it did not extend beyond the edges of the aluminum layer.

The fuse indicator label was applied to a 30 Amp fuse, and when the fuse was overcharged, the red PVC below the aluminum was exposed through the clear polyesters and adhesive. If the resistance of the conductive portion of the fuse indicator label is too low, (e.g., the thickness is too great), then the conductive portion of the fuse indicator will be too high and a clear indication may not be provided that the fuse has blown.

Those skilled in the art will appreciate that modifications and variations may be made to the above disclosed embodiments without departing from the spirit and scope of the invention.

What is claimed is:

1. A fuse indicator for indicating the status of a fuse, said fuse indicator comprising:

a discontinuous electrically conductive material extending between conductive ends of a fuse and including a gap therein providing a discontinuity, and undergoing a visible change in appearance upon being subjected to an electrical charge above a threshold;

a layer of indicator material that becomes exposed beneath said electrically conductive material when said fuse indicator is subjected to an electrical charge above a threshold; and adhesive material maintaining contact between said electrically conductive material and the conductive ends of the fuse.

2. A fuse indicator as claimed in claim 1, wherein said discontinuous electrically conductive material includes a dielectric material within said gap.

3. A fuse indicator as claimed in claim 1, wherein said indicator includes a film, at least a portion of which is clear, overlying said adhesive material.

4. A fuse indicator as claimed in claim 1, wherein said adhesive material includes a pressure sensitive material.

5. A fuse indicator as claimed in claim 1, wherein said discontinuous conductive material includes vacuum deposited aluminum.

6. A fuse including a plurality of fuse indicators for indicating the status of the fuse, said plurality of fuse indicators comprising:

a first indicator including an electrically conductive material extending between conductive ends of a fuse and undergoing a visible change in appearance upon being subjected to an electrical current above a first threshold; and a second indicator including a discontinuous electrically conductive material extending between conductive ends of a fuse and including a gap therein providing said discontinuity, said discontinuous electrically conductive material undergoing a visible change in appearance upon being subjected to an electrical charge above a second threshold.

7. A fuse indicator as claimed in claim 6, wherein said first indicator further includes a first layer of indicator material that becomes exposed beneath said electrically conductive material when said indicator is subjected to the electrical current above a first threshold.

8. A fuse indicator as claimed in claim 6, wherein said second indicator further includes a second layer of indicator material that becomes exposed beneath said discontinuous electrically conductive material when said first indicator is subjected to the electrical charge above a second threshold.

* * * * *